US008516725B1

(12) United States Patent
George

(10) Patent No.: US 8,516,725 B1
(45) Date of Patent: Aug. 27, 2013

(54) FOOTWEAR ACCESSORY

(76) Inventor: Jeffrey George, Providence, RI (US)

( * ) Notice: Subject to any disclaimer, the term of this patent is extended or adjusted under 35 U.S.C. 154(b) by 461 days.

(21) Appl. No.: 12/861,987

(22) Filed: Aug. 24, 2010

(51) Int. Cl.
*A43C 11/00* (2006.01)

(52) U.S. Cl.
USPC ..... 36/136; 36/50.1; 24/714.8

(58) Field of Classification Search
USPC ..... 25/714.6, 714.7, 714.8; 36/50.1, 36/136; 24/714.6, 714.7, 714.8
See application file for complete search history.

(56) References Cited

U.S. PATENT DOCUMENTS

| | | | | | |
|---|---|---|---|---|---|
| 156,218 | A | | 10/1874 | Haight | |
| 736,106 | A | * | 8/1903 | Johnston | 24/714.8 |
| 785,179 | A | * | 3/1905 | McIntyre | 24/714.8 |
| 1,166,344 | A | | 12/1915 | Freeburg | |
| 1,505,430 | A | * | 8/1924 | Roberts et al. | 24/714.8 |
| 3,333,304 | A | * | 8/1967 | Daddona, Jr. | 24/715.2 |
| 3,822,489 | A | | 7/1974 | Johnson | |
| 4,071,964 | A | | 2/1978 | Vogiatzis | |
| 4,597,198 | A | | 7/1986 | Schweitzer | |
| 4,858,282 | A | | 8/1989 | DuPont, Jr. | |
| 4,991,273 | A | | 2/1991 | Huttle | |
| 5,052,131 | A | | 10/1991 | Rondini | |
| 5,109,581 | A | | 5/1992 | Gould | |
| 5,209,000 | A | | 5/1993 | Rowland et al. | |
| 5,316,189 | A | | 5/1994 | Galeros et al. | |
| 5,347,695 | A | * | 9/1994 | Lopez Saiz | 24/714.8 |
| 5,471,769 | A | | 12/1995 | Sink | |
| 5,526,585 | A | * | 6/1996 | Brown et al. | 36/50.1 |
| 5,572,774 | A | * | 11/1996 | Duren | 24/306 |
| 5,632,709 | A | | 5/1997 | Walsh | |
| 5,649,342 | A | | 7/1997 | D'Andrade et al. | |
| 5,722,757 | A | | 3/1998 | Chien | |
| 5,845,422 | A | | 12/1998 | Valteau, III | |
| 6,240,657 | B1 | * | 6/2001 | Weber et al. | 36/50.1 |
| 6,477,754 | B1 | | 11/2002 | Alexander | |
| 6,546,649 | B1 | | 4/2003 | Tobias | |
| 6,581,256 | B2 | | 6/2003 | Liu | |
| 6,679,405 | B2 | | 1/2004 | Zalis-Hecker et al. | |
| 6,701,589 | B1 | | 3/2004 | Kliewer | |
| 7,036,194 | B2 | | 5/2006 | Tricker | |
| 7,069,626 | B2 | * | 7/2006 | Issler | 24/714.6 |
| 2005/0132546 | A1 | | 6/2005 | Cheng | |
| 2005/0144812 | A1 | | 7/2005 | Wheeler | |
| 2006/0260153 | A1 | | 11/2006 | Stewart White | |
| 2008/0000107 | A1 | | 1/2008 | Styles | |
| 2008/0086917 | A1 | | 4/2008 | Carrillo | |
| 2008/0141560 | A1 | * | 6/2008 | Lewis | 36/50.1 |
| 2008/0163514 | A1 | | 7/2008 | Stassinopoulos | |
| 2008/0222861 | A1 | | 9/2008 | Son | |
| 2008/0229563 | A1 | | 9/2008 | Cohen et al. | |
| 2009/0077778 | A1 | | 3/2009 | Quiroz et al. | |
| 2009/0094794 | A1 | | 4/2009 | Murray et al. | |

* cited by examiner

*Primary Examiner* — Marie Patterson
(74) *Attorney, Agent, or Firm* — Salter & Michaelson

(57) ABSTRACT

An ornamental accessory for footwear in which the footwear is of the type having a series of lacing holes that are spaced apart along a lacing surface of the footwear and that are usually adapted for receipt of footwear laces. The ornamental accessory includes an accessory insert that is comprised of an open link and an integrally formed support post. The open link has a passage that is larger than the size of the lacing hole so as to accommodate a chain piece. The support post is constructed and arranged to interlock with the lacing hole.

11 Claims, 4 Drawing Sheets

FOOTWEAR ACCESSORY

FIELD OF THE INVENTION

The present invention relates to an improvement in an accessory for footwear. More particularly, the present invention relates to an accessory insert that enables the substitution of a more decorative elongated member such as a chain member in place of the standard footwear lacing. Even more particularly, the present invention relates to an accessory insert particularly adapted for use with sneakers or similar footwear.

BACKGROUND OF THE INVENTION

The standard sneaker is provided with small lacing holes that accept a lace that is threaded from side to side about the tongue of the sneaker. There does exist some prior art that associates decorative or ornamental pieces with the sneaker or shoe. However, these decorative or ornamental pieces are generally attached to the existing lacing. By way of example, refer to U.S. Patent Publication No. 2008/0086917 which shows an ornamental device having openings through which the lacing extends. Refer also to U.S. Patent Publication No. 2009/0077778 which describes an ornamental piece for attachment to the end of a lacing. Refer also to U.S. Pat. No. 6,477,754 for an illustration of a further ornamental piece attached to the lacing itself.

It is an object of the present invention to provide an improved ornamental accessory for footwear and in which an insert is used that enables the ready substitution, for the lacing, of a more decorative member such as a metal chain.

SUMMARY OF THE INVENTION

To accomplish the foregoing and other objects of the present invention there is provided an ornamental accessory for footwear in which the footwear is of the type having a series of lacing holes that are spaced apart along a lacing surface of the footwear and that are usually adapted for receipt of footwear laces. The accessory includes an accessory insert that is comprised of an open link and an integrally formed support post, the open link forming a passage that is larger than the size of the lacing hole so as to accommodate a chain piece. The support post is constructed and arranged to interlock with the lacing hole.

In accordance with other aspects of the present invention the accessory insert is constructed of a metal material; the accessory insert is constructed of a plastic material; the passage in the open link is at least one of circular, oval, triangular, square, rectangular or star-shaped; the support post extends substantially orthogonal to the plane of the open link so that the open link lies flat against the lacing surface; the support post has one end attached to the open link and an opposite free end; the free end of the support post includes an enlargement piece that is adapted for positioning inside of the lacing surface for securing the accessory insert in place; the enlargement piece is a ball end having a diameter that is greater than the diameter of the lacing hole; the support post has one end attached to the open link and an opposite free end; the free end of the support post includes an enlargement piece that is adapted for positioning inside of the lacing surface for securing the accessory insert in place.

Also, in accordance with the present invention there is provided an ornamental accessory for footwear in which the footwear is of the type having a series of lacing holes that are spaced apart along a lacing surface of the footwear. The accessory includes an accessory insert that is comprised of an open link and an integrally formed support post, said open link having a through passage and said support post including an end enlargement for engagement with the lacing hole.

In accordance with other aspects of the present invention the open link passage is larger than the size of the lacing hole so as to accommodate a chain piece, and the support post being constructed and arranged to interlock with the lacing hole; the accessory insert is constructed of a metal or plastic material; the passage in the open link is at least one of circular, oval, triangular, square, rectangular or star-shaped; the support post extends substantially orthogonal to the plane of the open link so that the open link lies flat against the lacing surface; the enlargement piece is adapted for positioning inside of the lacing surface for securing the accessory insert in place; the enlargement piece is a ball end having a diameter that is greater than the diameter of the lacing hole.

In accordance with the present invention there is also provided a method of converting lacing provided on footwear to the acceptance of an elongated chain by means of an ornamental accessory in which the footwear is of the type having a series of lacing holes that are spaced apart along a lacing surface of the footwear and that are usually adapted for receipt of the footwear laces. The method comprises providing an accessory insert that includes an open link and an integrally formed support post, the open link defining a passage that is larger than the size of the lacing hole, engaging the accessory insert with the footwear by inserting the support post through the lacing hole, and threading the elongated chain through the open link passage. Additional steps include providing a plurality of accessory inserts are engaged so as to accommodate the chain through successive open link, and providing an enlargement end on the support post and forcing the enlargement end of the support post through the lacing hole so as to position the enlargement end inside of the lacing surface and thus firmly engage the accessory insert with the footwear.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
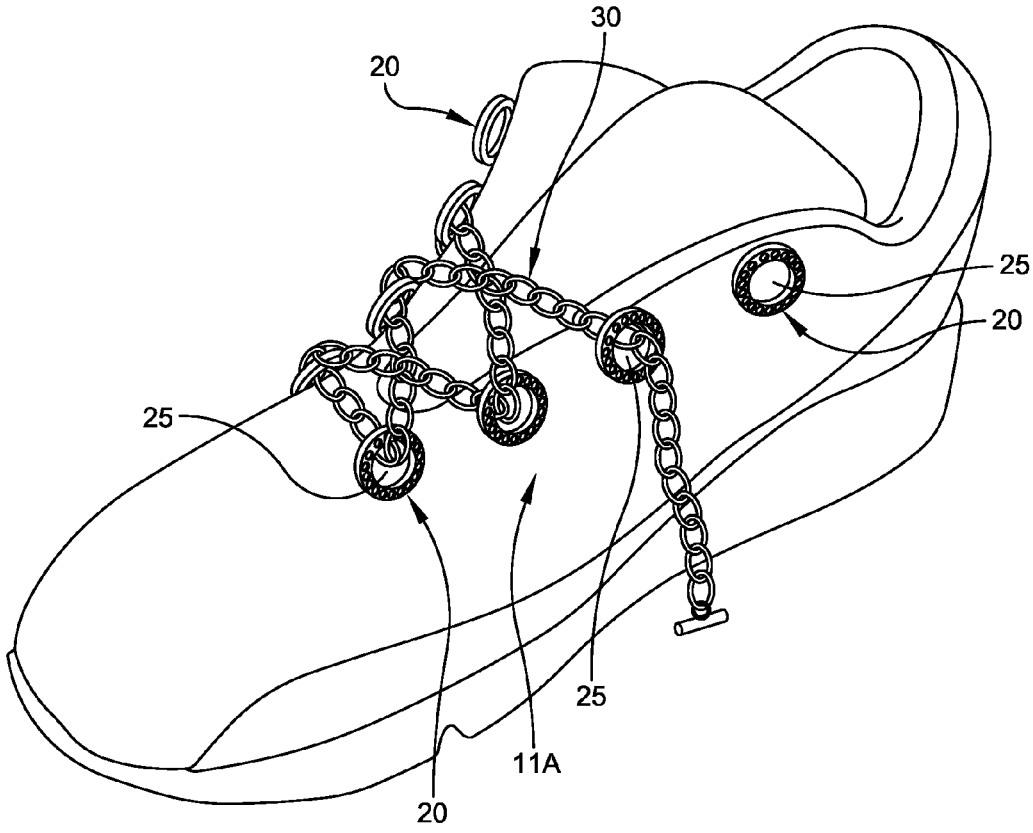
FIG. 1 is a perspective view illustrating the ornamental accessory of the present invention as associated with a sneaker.
Figure 2:
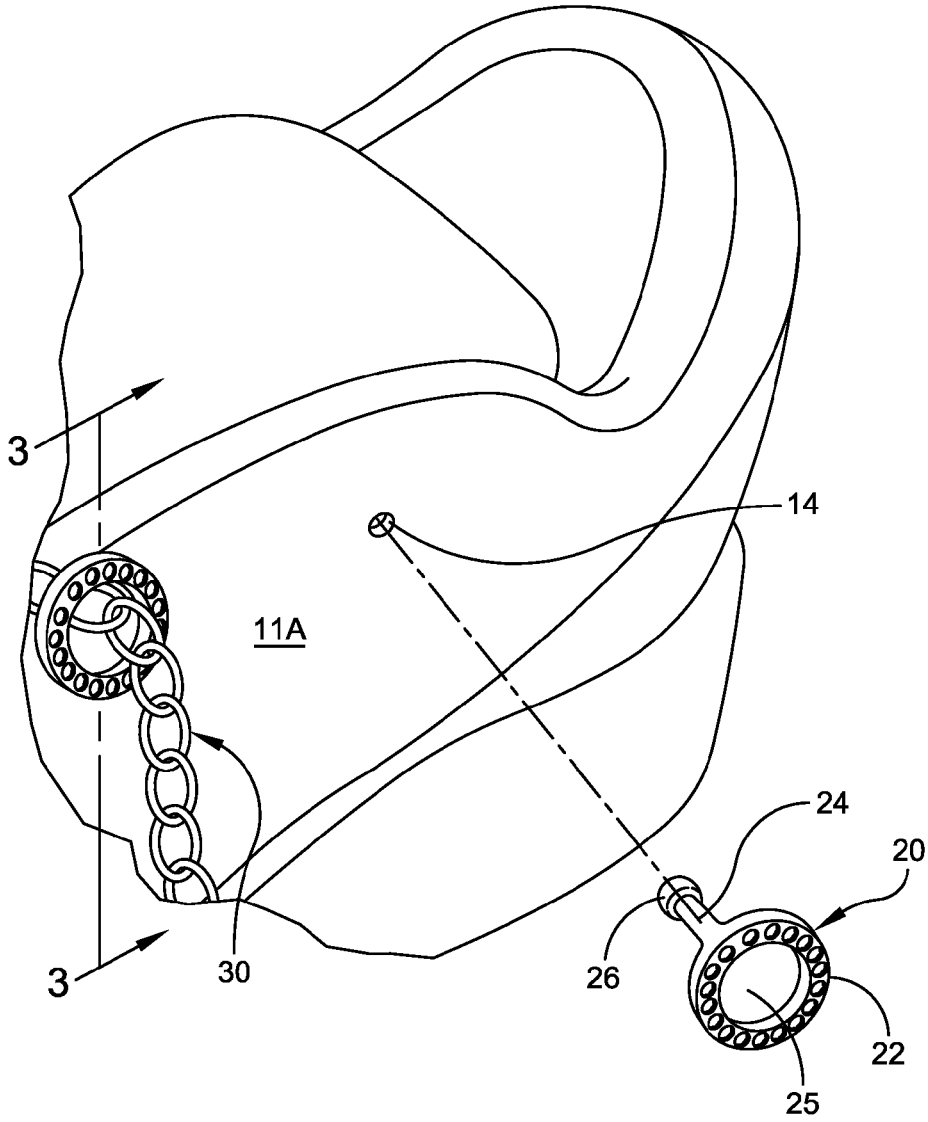
FIG. 2 is a fragmentary view illustrating the accessory insert as exploded away from the sneaker and illustrating the typical sneaker hole.

Reference is now made to the drawings for a further illustration of the ornamental footwear accessory. Reference to these drawings will also be made in connection with a method to be described hereinafter. This method relates primarily to the technique for applying the insert so that, rather than securing the sneaker by laces, a more ornamental arrangement is allowed by virtue of the insert having a larger passage for receiving, for example, a metal chain or the like ornamental elongated structure.

The accessory insert of the present invention may also be referred to as a hole converter in that it allows the ready adaptation of using a metal chain essentially as a lace in place of the conventional cloth lacing. This insert or hole converter thus essentially allows one to convert the relatively small shoe lace hole into a larger hole or passage that can readily then receive a larger sized elongated member such as an elongated metal chain. The metal chain, for example, provides a much more decorative effect to the sneakers, particularly in comparison with the standard lacing.

Now, with further reference to the drawings, there is illustrated a sneaker 10 that may be considered of conventional design including an upper 11 and a tongue 12. A series of relatively small diameter holes 14 are provided along the surface 11A. These holes 14 are typically spaced along the surface 11A and are meant to receive a standard lacing (not shown in the drawings). A typical diameter of each hole 14 may be on the order of 2 mm.

Figure 4:
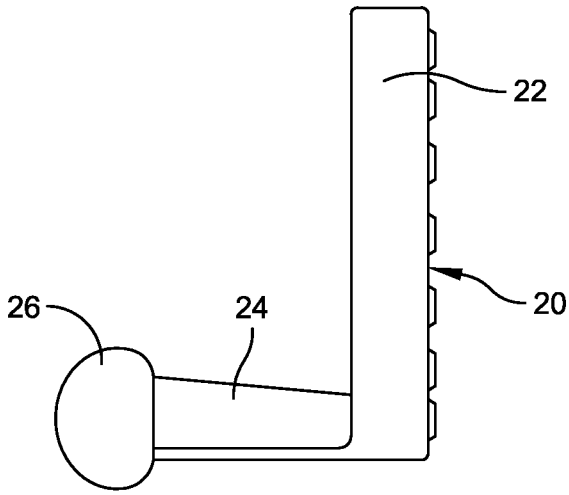
FIG. 4 is a side elevation view of one embodiment of the accessory insert of the present invention.

The drawings also illustrate the accessory insert 20 which is basically comprised of an open link 22 and a support post 24 that is integrally formed with the open link 22. As noted in, for example, FIG. 4 the support post 24 is basically cylindrical and is provided with an end enlargement piece 26 that is preferably spherical. As also noted in FIG. 4, the support post 24 extends substantially orthogonal to the plane of the link 22 which would be a horizontal plane in FIG. 4.

In the embodiment illustrated in the drawings herein, the open link 22 is basically oval in shape. The accessory insert may be constructed of a material such as a metal or plastic material. The oval shape illustrated in the drawings of the open link provides an oval-shaped passage 25. As is readily apparent from the drawings, the passage 25 is substantially larger than the lacing holes 14. Thus, the passage 25 can readily receive an elongated member such as the chain 30 illustrated herein. The chain 30 is meant to thread through the links 22 in the manner as illustrated. The chain 30 can be threaded through the links in a number of different threading patterns.

The spherical or ball end 26 of the insert may have a diameter on the order of 5 mm and is thus larger than the corresponding hole 14. However, the material of the surface 11A is a pliable material and the insert can be firmly engaged with the whole 14 by passing the support post, and in particular the end enlargement piece 26 through the hole 14 until the enlargement piece rests on the inside surface, thus essentially interlocking the accessory insert with the sneaker and at the location of the previously formed hole 14. The link thus receives the metal chain which is in the form of a lacing itself. However, the metal chain provides a much more decorative and ornamental effect than a plain lacing. From a marketing standpoint the chain and converter links may be sold together in a package or the converter links may be sold separately. Even though the ball end has a larger diameter than the hole in the sneaker surface, each of the links can be easily removed so that the sneakers, or in some cases shoes or boots, can be used with conventional shoe laces.

The size of the passage 25 is certainly significantly larger than the diameter of the receiving hole 14. This provides ample room for chains or other elongated members of various sizes to easily pass through the passage 25. The use of a metal chain or the like provides a decorative effect for the shoe or sneaker and yet still can function as a lacing. Both the metal chain, as well as the accessory insert can readily be made by machine. For example, the inserts can be constructed by casting rubber molds or injection molding.

Figure 3:
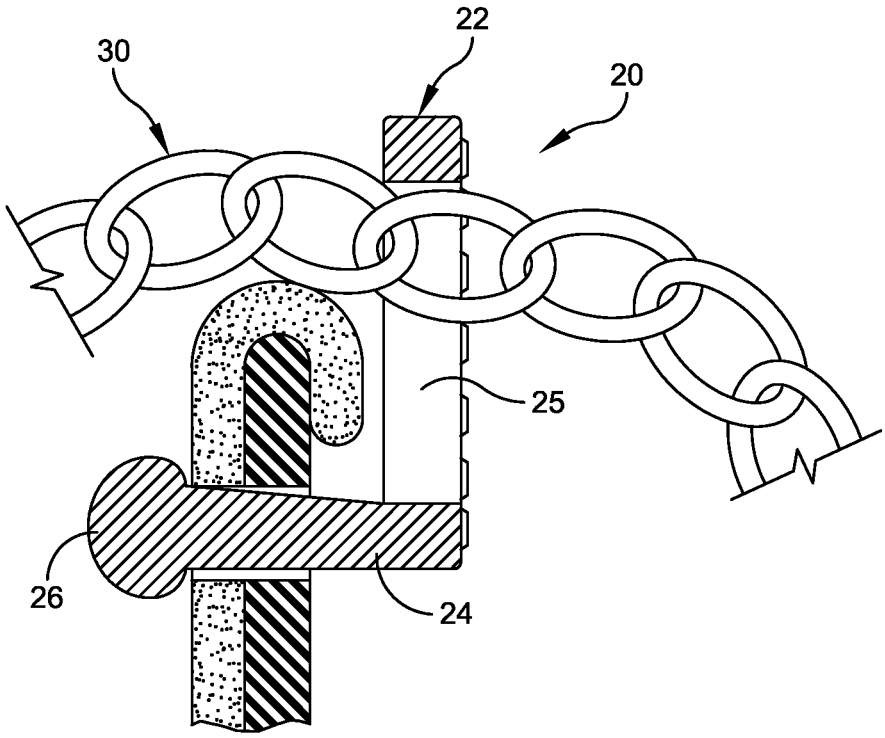
FIG. 3 is a cross-sectional view taken along line 3-3 of FIG. 1.

In the embodiment described herein, it is noted that the support post 24 is provided with a ball end 26. In other embodiments of the present invention the end 26 may take on other forms of an enlargement relative to the main cylindrical part of the support post. Reference may be made in particular to the cross-sectional view of FIG. 3 which illustrates the insert having been pushed through the hole 14 with the ball end 26 on the inner surface while the open link 22 is on the outer surface.

Figure 5:
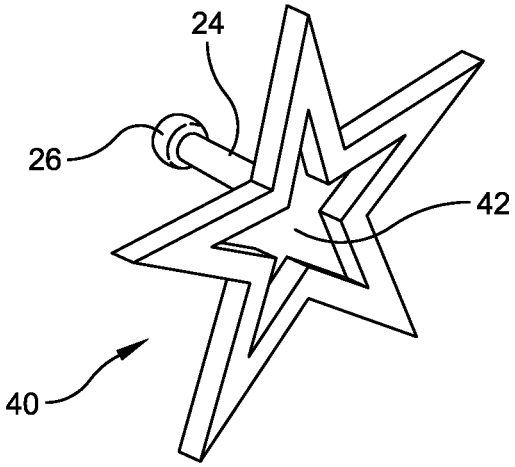
FIG. 5 shows an alternate form of the open loop link of the insert, in the form of a star structure.

In FIGS. 1-4, the open link is oval. However, the open link may also take on a number of different forms. The open link, and its associated passage may be circular, oval, triangular, square, rectangular or star-shaped as illustrated in FIG. 5 at 40 having a corresponding star-shaped passage 42. The passage within the open link may be of the same shape as the outer contour of the open link or it could be of a different configuration. For example, in the version of FIG. 5, the inner passage could be circular even though the outer shape is star-shaped.

Thus, the support post has one end attached to the open link and an opposite free end. It is the free end of the support post that includes the enlargement 26 that is adapted for positioning inside of the lacing surface for securing the accessory insert in place. Thus, the enlargement piece, such as the preferred ball end 26 has a diameter that is greater than the diameter of the lacing hole. Again, refer to the cross-sectional view of FIG. 3.

In accordance with the present invention, there is also provided a method for essentially converting lacing that is normally provided on footwear, such as sneakers, so that there is an acceptance of an elongated chain or the like by means of an ornamental accessory. The footwear is generally of the type having a series of lacing holes that are spaced apart along a lacing surface of the footwear and that are usually adapted for receipt of the footwear lacing. In accordance with the method of the present invention, there is provided an accessory insert that includes an open link and an integrally formed support post with the open link defining a passage that is larger than the size of the lacing hole. The accessory insert engages with the footwear by inserting the support post through the lacing hole, and threading the elongated chain through the open link passage. Additional steps include providing a plurality of these accessory inserts engaged with the footwear so as to accommodate the chain through successive open links. The method includes providing an enlargement end on the support post and forcing the enlargement end of the support post through the lacing hole so as to position the enlargement end inside of the lacing surface and thus firmly engage the accessory insert with the footwear.

The ornamental footwear accessory of the present invention may also be used in the following manner. Taking a standard sneaker or shoe, one can remove the shoe laces that come with the sneaker or shoe. Then one would insert the metal or plastic insert into the shoe lace hole. After the series of inserts are properly secured in place in spaced apart relationship as shown in FIG. 1 herein, then one can assembly the metal chain through the links to complete the ornamentation of the sneaker or shoe. Although reference has been made to a chain herein, it is understood that other forms of elongated members may be used to provide an ornamental effect by threading through these separately disposed inserts.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. In combination, an ornamental accessory for footwear and footwear and in which the footwear is of the type having a series of lacing holes that are spaced apart along an outer lacing surface of an upper of the footwear under a footwear fabric upper top edge and that are usually adapted for receipt of footwear laces; an accessory insert that is comprised of an open annular rigid link and a support post that is integrally formed with the open annular link, the open annular link forming a central open passage that is larger than the size of the lacing hole so as to accommodate an elongated decorative member, and the support post being constructed and arranged to interlock with the lacing hole in a fixed position thereof;

wherein the annular link has a substantially planar inner surface and the support post has one end attached to the annular link at the inner surface thereof and an opposite free end;

wherein the support post is comprised of a substantially straight post that extends substantially orthogonal to the planar inner surface of the open link so that in the fixed position of the post the planar surface of the open link lies flat against the outer lacing surface;

wherein the free end of the support post includes an enlargement piece that is adapted for positioning inside of the lacing surface for securing the accessory insert in place;

wherein the enlargement piece has a diameter that is greater than the diameter of the lacing hole, as well as larger than the diameter of the support post;

and wherein the accessory insert, once fixed in position relative to the footwear, has the central open passage overlap the outer lacing surface and extend above the footwear fabric upper top edge so as to provide a portion of the passage for ready receipt of the elongated decorative member therethrough.

2. The ornamental accessory of claim 1 wherein the accessory insert is constructed of a metal material.

3. The ornamental accessory of claim 1 wherein the accessory insert is constructed of a plastic material.

4. The ornamental accessory of claim 1 wherein the passage in the open link is at least one of circular, oval, triangular, square, rectangular or star-shaped.

5. The ornamental accessory of claim 1 wherein the enlargement piece, in the fixed position of the post, is disposed against an inner surface of the upper.

6. The ornamental accessory of claim 5 wherein the insert is firmly engaged with the lacing hole by passing the support post enlargement piece through the hole until the enlargement piece rests on the inside surface, thus essentially interlocking the accessory insert with the footwear and at the location of the previously formed lacing hole.

7. The ornamental accessory of claim 6 wherein the enlargement piece is formed as a ball end.

8. The ornamental accessory of claim 5 wherein the enlargement piece is a ball end.

9. The ornamental accessory of claim 8 wherein the annular link is formed by a closed continuous loop having an inner circular edge that defines an outer boundary of the central open passage.

10. The ornamental accessory of claim 9 wherein the annular link also has a substantially planar outer surface that is substantially parallel to the inner planar surface, the outer surface being a decorative surface.

11. The ornamental accessory of claim 10 wherein the passage has upper and lower contiguous passage portions with the upper passage portion forming an area where the elongated member passes and the lower passage portion is disposed against the upper outer surface.

* * * * *